US006726207B1

(12) United States Patent
Jacobus

(10) Patent No.: US 6,726,207 B1
(45) Date of Patent: Apr. 27, 2004

(54) CASTING GAME APPARATUS

(76) Inventor: James L. Jacobus, 15710 Center Village Rd., Johnstown, OH (US) 43031

( * ) Notice: Subject to any disclaimer, the term of this patent is extended or adjusted under 35 U.S.C. 154(b) by 0 days.

(21) Appl. No.: 10/034,263

(22) Filed: Oct. 19, 2001

(51) Int. Cl.[7] ..... A63F 9/00
(52) U.S. Cl. ..... 273/343; 273/447
(58) Field of Search ..... 273/333, 340, 273/391, 440, 447, 343

(56) References Cited

U.S. PATENT DOCUMENTS

| | | | | | |
|---|---|---|---|---|---|
| 1,733,606 | A | * | 10/1929 | Junker | 273/375 |
| 1,989,484 | A | * | 1/1935 | Maryfield et al. | 273/402 |
| 3,082,005 | A | * | 3/1963 | Kron | 473/192 |
| 3,554,550 | A | * | 1/1971 | Schram | 273/388 |
| 3,599,977 | A | * | 8/1971 | Glass et al. | 273/388 |
| 3,873,097 | A | * | 3/1975 | Willis | 473/189 |
| 4,116,443 | A | * | 9/1978 | Dorfman | 273/388 |
| 5,094,461 | A | * | 3/1992 | Lowrance | 273/343 |
| 5,181,721 | A | * | 1/1993 | Halliburton | 473/189 |
| 5,639,093 | A | | 6/1997 | Law et al. | |
| 5,657,995 | A | * | 8/1997 | Howard | 273/333 |
| 5,896,693 | A | | 4/1999 | Ray | |
| 5,941,528 | A | | 8/1999 | Bolvin, Jr. | |

* cited by examiner

*Primary Examiner*—Mark S. Graham
(74) *Attorney, Agent, or Firm*—Jason H. Foster; Kremblas, Foster, Phillips & Pollick

(57) ABSTRACT

A casting game includes a panel with targets. The targets are doors that pivot between a closed position, in which the doors are substantially parallel to the panel, and an open position, in which the doors are transverse to the panel. A user casts an object, such as a simulated lure, at the panel aiming to hit a door with a force sufficient to make the door pivot from the closed position to the open position. The user resets the game by maneuvering the lure to cooperate with structures on the apparatus that force the door to pivot from the open position to the closed position.

22 Claims, 4 Drawing Sheets

CASTING GAME APPARATUS

BACKGROUND OF THE INVENTION

1. Field of the Invention

The present invention relates to a casting game apparatus and more particularly to a device that provides targets at which a player casts an object. The invention is useful for practicing skills used when fishing.

2. Description of the Related Art

Games exist for practicing the casting process, which is usually employed as a technique for positioning or moving a lure or bait in a location for catching fish or other creatures. Casting games generally involve casting an object at a target. Some targets are designed to simulate specific types of creatures and natural obstacles encountered when casting for those creatures. Such targets require a user to apply skills and techniques to the casting process in various ways, such as when fly-casting on flowing water or flip-casting around obstacles like roots, stumps and logs. Casting games and practice devices may also be used to improve execution and accuracy of casting.

U.S. Pat. No. 5,639,093 issued to Law et al. is entitled "CASTING TARGET" and discloses a device for practicing fishing casting. The device includes a fish-shaped receiving structure with a mouth-shaped cavity for receiving an actual fish lure. An indicator assembly housed in the receiving structure indicates that the lure has been received. If the lure is successfully cast into the mouth-shaped cavity, the indicator is triggered, and a motorized fish tail wags in response. Also disclosed is a method of casting a lure at the receiving structure on the casting target.

U.S. Pat. No. 5,657,995 issued to Howard is entitled "LEAPING FISH GAME AND TRAINING AID" and discloses a board game having a fishing theme. Recessed areas on the game board house fish-shaped pieces that spring upwardly from the board. A player catches the fish-shaped pieces using a fishing rod with a simulated lure. The game teaches the player how to cast and retrieve using a fishing rod and reel.

U.S. Pat. No. 5,896,693 issued to Ray is entitled "SPIN CAST AND FLIPPING TARGET PAD" and discloses a casting target. The device consists of a receptacle in the shape of a fish head surrounded by raised portions in the shape of lily pads. The invention provides feedback to a user that indicates in which direction the target was missed. The invention is compatible with real fish lures and is adapted to float.

U.S. Pat. No. 5,941,528 issued to Boivin is entitled "FISHING CASTING PRACTICE DEVICE" and discloses a box-shaped housing having a series of casting targets. Each target is uniquely shaped to receive a fish lure that was cast using a specific casting technique.

The need exists for a casting game apparatus that is portable and capable of being used on solid surfaces. The apparatus should have targets and sites where accessories such as artificial foliage and additional targets can be attached for varying the difficulty level of the game. The game should provide an immediate response to indicate that the target has been hit. The user should be able to reset the target through a successfully maneuvered cast, and therefore the apparatus should include structures that cooperate with the cast object to reset the target. In this way the user can practice casting skills while resetting the target.

BRIEF SUMMARY OF THE INVENTION

The invention is a casting game apparatus that has a stationary panel with a front face and a back face. At least one frontwardly-pivoting door and at least one rearwardly-pivoting door are mounted to the panel and serve as targets. An object that has weight and that simulates a fishing lure is tied to a string and cast at one of the doors. When the lure hits a door, it causes the door to pivot from a closed position to an open position. A user aims and casts the "lure" to hit the doors to cause a response.

The doors are pivotally mounted to the panel for moving from the closed position, in which the doors are substantially parallel to the panel, to the open position, in which the doors are transverse to the panel, upon being hit by the lure. The rearwardly-pivoting door is reset to the closed position by casting the lure into a resetting mechanism and reeling the lure in. The frontwardly-pivoting door is also reset to the closed position by a casting and reeling maneuver. The structure that accommodates the resetting of the frontwardly-pivoting door is apertures formed through a lip mounted above the frontwardly-pivoting doors. On each frontwardly-pivoting door that is in the open position, the distance between a crest of the aperture for that door and the panel is greater than the distance between a deepest point of a slot on that door and the panel. This relationship permits a lure that is cast through an aperture to fall below the corresponding door, and the string tethering the lure to fall into the slot on the door. When the lure is reeled in, the reeling force raises the door because the lure cannot pass through the slot.

Figure 1:
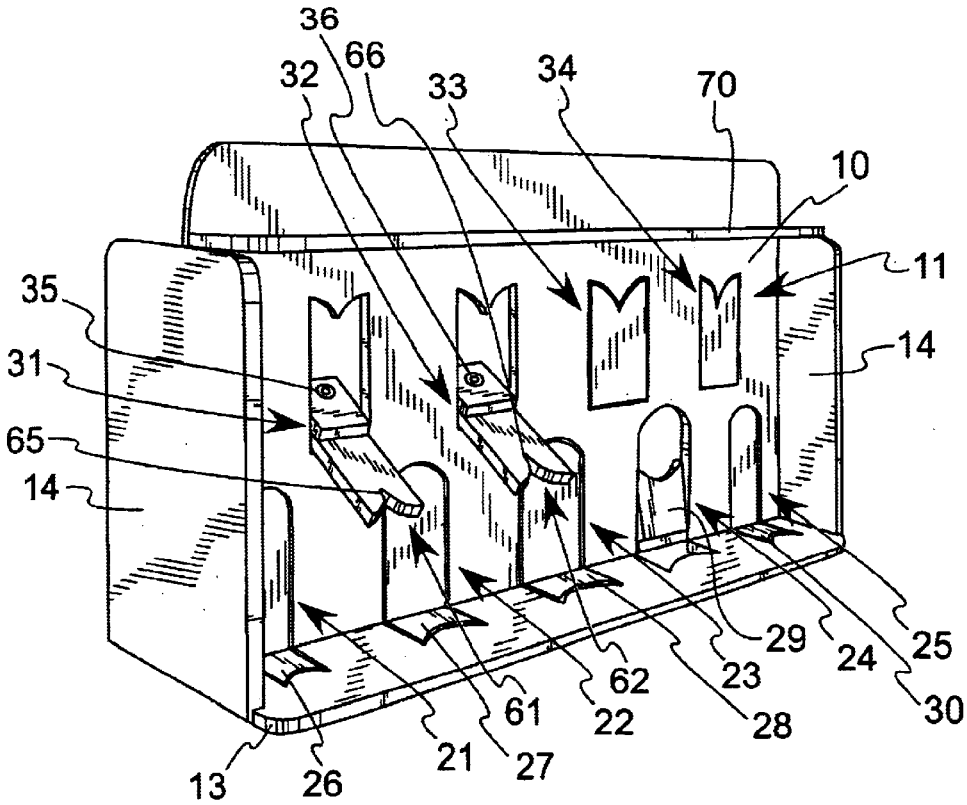
FIG. 1 is a front view in perspective illustrating the preferred embodiment of the present invention.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents which operate in a similar manner to accomplish a similar purpose. For example, the word "connected" or term "similar thereto" is often used. They are not limited to direct connection, but include connection through other elements where such connection is recognized as being equivalent by those skilled in the art.

DETAILED DESCRIPTION OF THE INVENTION

Figure 8:
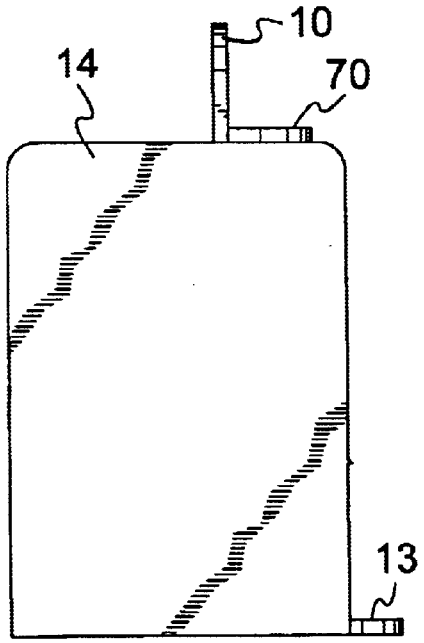
FIG. 8 is a side view of the preferred embodiment of the present invention.
Figure 9:
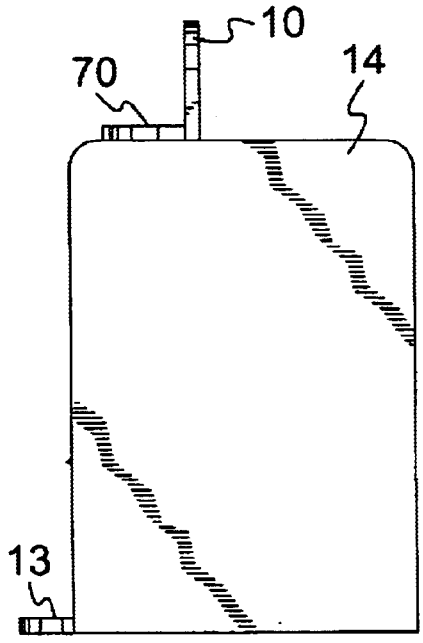
FIG. 9 is a side view of the preferred embodiment of the present invention.

As shown in FIGS. 1–4, a stationary panel 10 has a front face 11 and a back face 12. The front face 11 faces generally toward a player during use of the game apparatus. The panel 10 is fixed substantially perpendicular to a base 13. A pair of sidewalls 14 is fixed substantially perpendicular to the panel 10 and to the base 13, as shown in FIGS. 8 and 9. The panel 10, the base 13, and the sidewalls 14 are preferably made of wood or a wood composite, such as particle board, but alternatively may be a material having similar characteristics, such as injection-molded plastic. The panel 10 shown is rectangular, having preferred dimensions of about 15⅜"×28¼", although the size and shape may vary significantly depending upon the intended use of the game apparatus and other factors that will be understood to those of skill in the art of game apparatuses.

Figure 2:
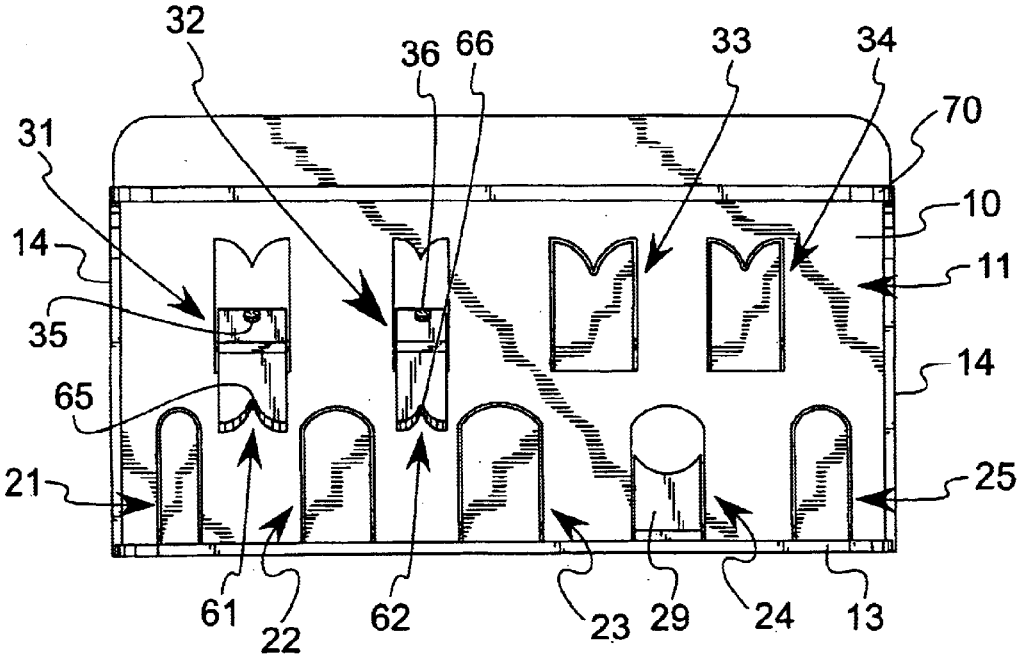
FIG. 2 is a front view illustrating the preferred embodiment of the present invention.
Figure 3:
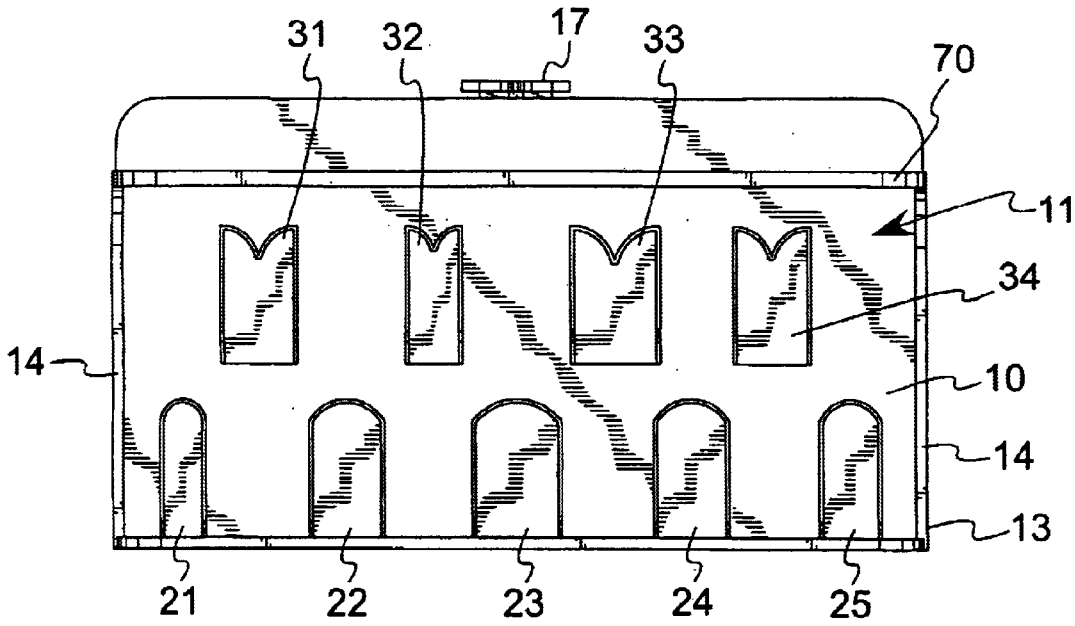
FIG. 3 is a front view illustrating the preferred embodiment of the present invention.
Figure 4:
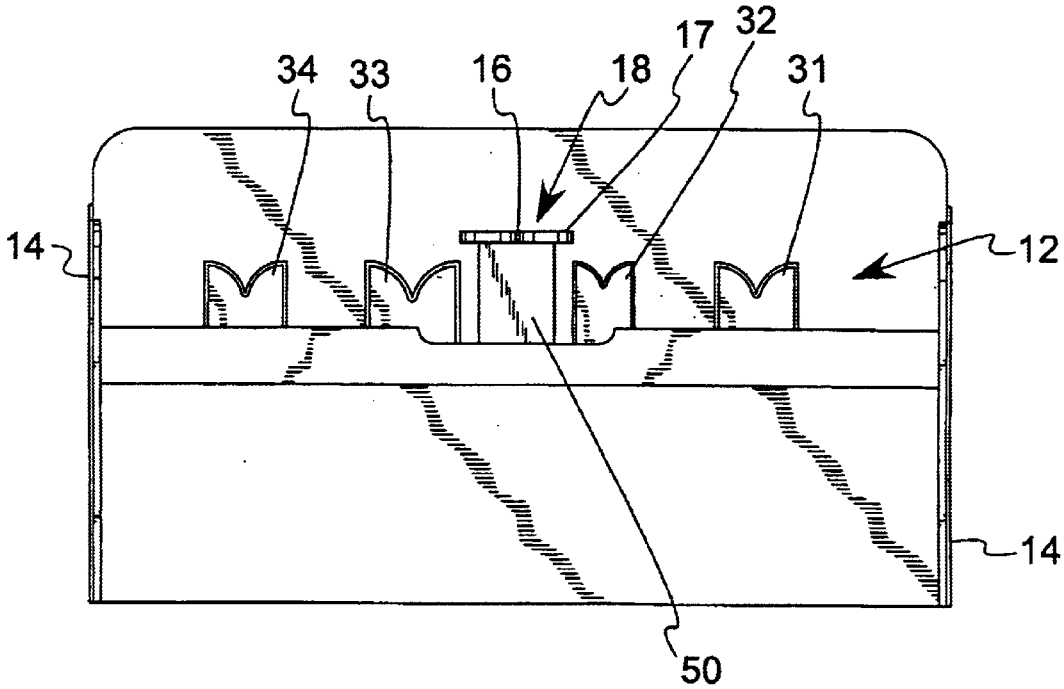
FIG. 4 is a rear view illustrating the preferred embodiment of the present invention.

As shown in FIGS. 1–3, the panel 10 has a plurality of targets, each of which is formed as one of two types of doors attached to the panel 10. In the preferred embodiment, five rearwardly-pivoting doors 21, 22, 23, 24, and 25, and four frontwardly-pivoting doors 31, 32, 33, and 34, are pivotally mounted to the panel 10. Of course, the number, size and relative positions of each type of door could vary substantially, as these characteristics are not critical for the game apparatus to function.

The doors 21–25 and 31–34 are attached to the panel 10 by a pivot axle 8 (see FIG. 7) extending through the backs of each of the doors that enables the doors to pivot between a closed position, in which the doors are substantially parallel to the panel 10, and an open position, in which the doors are transverse to the panel 10. Each of the doors 21–25 and 31–34 has a front face and a back face. In the closed position each door is substantially parallel to, and preferably coplanar with, the panel 10.

The preferred doors are formed from pieces of the panel 10 that were removed from the panel 10 during manufacture of the apparatus using a tool, such as a router or jigsaw, to cut the panel 10. During the manufacturing process, the tool cuts the doors out of the panel 10, thereby forming door-shaped holes in the panel 10. The router bit or jigsaw blade removes material when it cuts the door-shaped holes, thus leaving a space between the edge of each hole in the panel 10 and the adjacent edge of the door-shaped piece that is then pivotally-mounted to the panel 10 to fit in the space from which the piece was removed. Each of the rearwardly-pivoting doors 21–25 is also L-shaped, when viewed from the side, because each door is made from one of the pieces cut out of the panel 10 and another piece cut out of the base 13. The base piece is joined, preferably at a right angle, to the panel piece to form a lower leg on each door. The lower legs serve as counterweights 26–30, discussed below, on the rearwardly-pivoting doors 21–25.

The rearwardly pivoting doors 21–25 are mounted to the panel 10 on a single hinge pin 8, and the doors 31–34 are mounted to the panel 10 on a single hinge pin 9. The hinge pins 8 and 9 for each set of doors 21–25 and 31–34 extend horizontally through the panel 10 and the doors. Doors of the same type and in the same row preferably share a hinge pin. Thus, the preferred embodiment has two hinge pins: one for the doors 31–34 in the top row and another for the doors 21–25 in the bottom row.

In the preferred embodiment, the rearwardly-pivoting doors 21–25 are aligned in a row below the frontwardly-pivoting doors 31–34, which are also aligned in their own row. The doors 21–25 and 31–34 are spaced within each row to form an alternating pattern between each row across the front face 11 of the panel 10, i.e. no frontwardly-pivoting door in the upper row is directly above any rearwardly-pivoting door in the bottom row, as shown in FIG. 3. Of course, this pattern is preferred, but not necessary, and any alignment possible will become apparent to a person of ordinary skill in the art.

The rearwardly-pivoting doors 21–25 are preferably of various sizes for variety and to permit higher point values to be assigned to smaller doors, which are more difficult to hit.

In the closed position, the centers of gravity of the rearwardly-pivoting doors 21–25 are in front of the pivot pin 8, which is the pivot axis, by virtue of the counterweights 26–30 on the L-shaped doors. These counterweighting lower legs 26–30 keep the rearwardly-pivoting doors 21–25 in the closed position, as shown in FIGS. 1 and 2, when they are in or near the closed position. When the rearwardly-pivoting doors 21–25 are in the closed position, their respective counterweights 26–30 are substantially parallel to the base 13, and their centers of gravity are positioned in front of the pivot pin 8 to bias the doors 21–25 closed.

When the lure strikes the front face of one of the rearwardly-pivoting doors 21–25 with sufficient force, the impact force overcomes the bias force of the attached counterweight, thereby pivoting that door backwardly to the open position. Once opened, the rearwardly-pivoting doors 21–25 stay in the open position, because as one of the doors 21–25 swings back toward the open position, the closing bias of that door is overcome as its center of gravity moves behind the pivot pin 8. This new position of the door, and thus the center of gravity, biases the door open.

Figure 6:
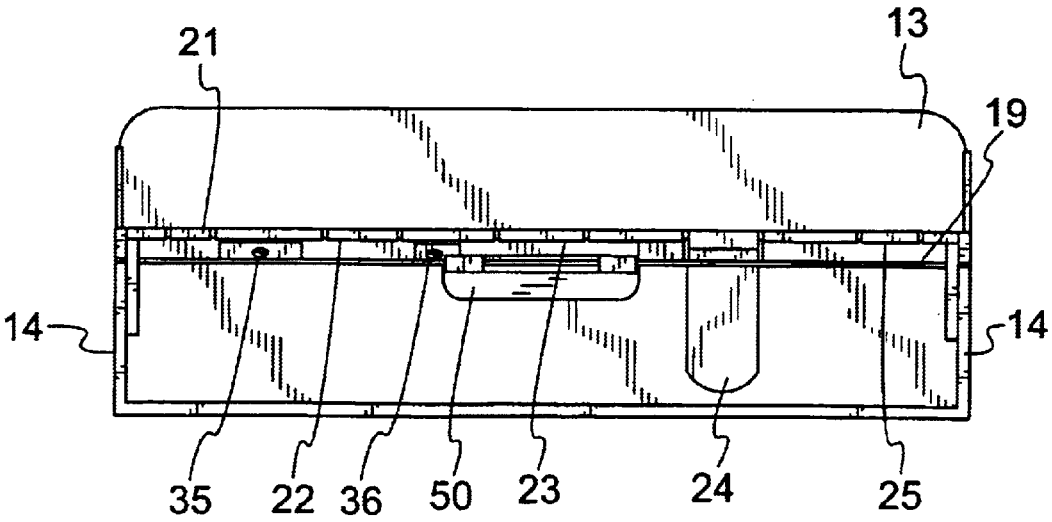
FIG. 6 is a bottom view illustrating the preferred embodiment of the present invention.
Figure 7:
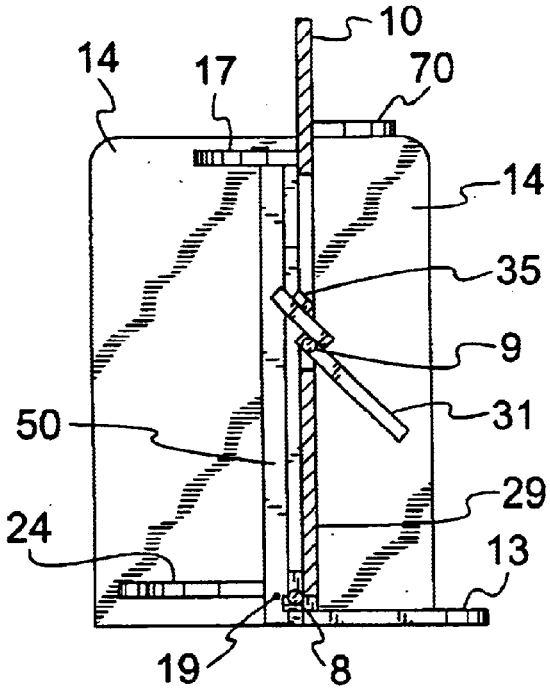
FIG. 7 is a side view in section through the lines 7—7 of FIG. 6 illustrating the preferred embodiment of the present invention.

In summary, therefore, the player casts the lure, aiming to hit one of the rearwardly-pivoting doors 21–25 with a force sufficient to overcome the opposing force of the counterweights 26–30. If hit with sufficient force, then that rearwardly-pivoting door will pivot backward about its pivot axis and move away from the player. In FIGS. 1 and 2, the rearwardly-pivoting door 24 is shown in the open position. As shown in FIGS. 6 and 7, the open rearwardly-pivoting door 24 pivots backwardly until contact is made with an upwardly-moving catch and reset rod 19. The player next attempt to return the door 24 to the closed position through a subsequent casting maneuver.

Figure 5:
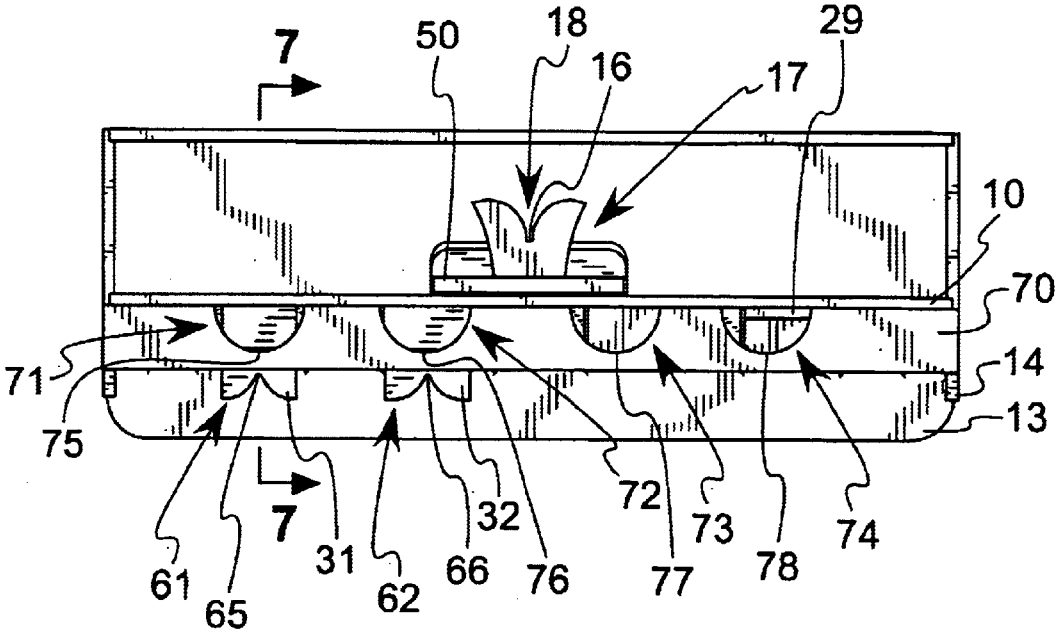
FIG. 5 is a top view illustrating the preferred embodiment of the present invention.

The catch and reset rod 19 and other structures attached thereto return the rearwardly-pivoting doors 21–25 to the closed position. The catch and reset rod 19 extends substantially horizontally and parallel to the panel 10 between the sidewalls 14 as shown in FIG. 6. Grooves formed in the sidewalls 14 retain each end of the rod 19. The rod 19 is spaced a distance from the back face 12 of the panel 10 and is movably mounted for resetting the rearwardly-pivoting doors 21–25 to the closed position. The rod 19 attaches to a substantially vertically-oriented bar 50, which is slidingly mounted to the panel 10, for example by a drawer slide. The bar 50 has a lower end attached to the rod 19 and an opposite, upper end attached to a forked head 17. The forked head 17 is rigidly mounted to the rod 19, as shown in FIGS. 5 and 6.

To reset any or all of the rearwardly-pivoting doors 21–25, the player casts the lure over the top edge of the panel 10 in an attempt to "catch" a slot 18 formed on the forked head 17. This is accomplished by casting the lure beyond the forked head 17 with the string in the slot 18. The slot 18 has sides that arch, narrowing to a deepest point 16 of the slot 18. If the player is successful in his cast, then the string falls between the arched sides and is guided into the deepest point 16 of the slot 18 as the weight of the lure drives the string downwardly. The player then applies an upward force on the string, like when reeling in a fish, to cause the lure to move upward with the string and into contact with the underside of the forked head 17, which also moves upward in response, because the slot 18 is too small for the lure to pass through. This upward movement causes the bar 50 to be lifted, which in turn pulls the rod 19 upward, thereby lifting upward any of the rearwardly-pivoting doors 21–25 that are open. Any open doors move upwardly on their pivot axes in response to the upward force from the rod 19. As each of the rearwardly-pivoting doors 21–25 pivots upwardly, its center of gravity shifts from behind to in front of the pivot pin 8, thus biasing the rearwardly-pivoting doors 21–25 to the closed position.

Turning to the frontwardly-pivoting doors 31–34, the preferred embodiment of the invention has four frontwardly-pivoting doors 31–34 of preferably various sizes. In the preferred embodiment, the frontwardly-pivoting doors 31–34 are magnetically held in the closed position by magnets 35–38. A magnet on each door cooperates with a piece of ferromagnetic material, such as a bolt or a screw that is attached to the panel 10, to hold in the closed position the frontwardly-pivoting doors.

In the closed position, the centers of gravity of each frontwardly-pivoting door is generally above the pivot axis, and the magnetic forces bias the doors to the closed position. When the lure strikes the back face of a frontwardly-pivoting door, which is described below, the frontwardly-directed impact overcomes the magnetic force, thereby pivoting that door forward to the open position. The frontwardly-pivoting door stays in the open position, because the magnetic force is overcome, and because the center of gravity falls, with the door, in front of the pivot pin 9.

In FIGS. 1 and 2, the frontwardly-pivoting doors 31 and 32 are shown in the open position. The opening of these doors is different from the rearwardly-pivoting doors, as briefly introduced above. In order to open the doors 31 and 32, the player casts the lure over the top edge of the panel 10 to contact the string to which the lure is attached with the top edge of the panel 10 and simultaneously stops feeding the string. The contact between the string and the top edge of the panel 10, combined with stopping the feeding of the string, stops the progression of the lure over the apparatus, thus causing the lure to swing in pendulum fashion against the back face 12 of the panel 10 about the contact point between the top edge of the panel 10 and the string. The goal is for the lure to strike a frontwardly-pivoting door 31–34 on the back face with a force sufficient to overcome the door-closing force of the magnet on the screw. If hit with sufficient force, one of the frontwardly-pivoting doors 31–34 will fall to the open position, which is forward relative to the panel 10 and toward the player.

As shown in FIGS. 1 and 7, when it is in the open position, the front face of each frontwardly-pivoting door contacts the bottom edge of the hole in which that door is mounted in the panel 10. This contact stops the forward pivoting movement of the door, and supports and suspends the frontwardly-pivoting doors transverse to the panel 10 in the open position, as illustrated with doors 31 and 32. Each of the frontwardly-pivoting doors 31–34 is prohibited by this contact from pivoting to a position substantially parallel to and against the front face 11 of the panel 10. As shown in FIGS. 1 and 7, the frontwardly-pivoting doors 31 and 32 are angled slightly down from the front face 11 of the panel 10.

The casting game has structures for resetting the frontwardly-pivoting doors 31–34 to the closed position, which are different from those for the rearwardly-pivoting doors 21–25. As shown in FIGS. 1–5, the frontwardly-pivoting door 31 has a slot 61 with a deepest point 65. The doors 32–34 have similar slots with deepest points that function the same as those of door 31. Another resetting structure is a lip 70 mounted to the panel 10 and having apertures 71–74 formed therein, as best shown in FIG. 5. Each of the apertures 71–74 is positioned above a corresponding one of the frontwardly-pivoting doors 31–34. The apertures 71–74 have crests 75–78, respectively, which are the regions of the apertures 71–74 farthest from the panel 10. The crests 75–78 are formed in the lip 70 at carefully-selected distances from the panel 10. For example, looking to the open door 32, and applying similarly to each frontwardly-pivoting door that is in the open position, the distance between the deepest point 66 of the slot 62 and the panel 10 is greater than the distance between the crest 76 and the panel 10. This structural relationship is true for the respective apertures and crests corresponding to the frontwardly-pivoting doors 31, 33 and 34. The reset function can of course be accomplished in alternative structures that will become apparent to the person of ordinary skill from this description.

In utilizing the structures that cooperate to return each of the frontwardly-pivoting doors to the closed position, the player casts the lure through the aperture above one of the doors, for example the aperture 71 above door 31 shown in FIG. 5. Again, the doors 32–34 have reset structures substantially identical to those of door 31, and therefore the following description of utilizing the reset structures for door 31 is applicable to doors 32–34. The cast lure falls through the aperture 71 and hits the open frontwardly-pivoting door 31. The player maneuvers the lure down past the frontwardly-pivoting door 31, thus facilitating the string making contact with the arched sides of the slot 61. Under the influence of gravity on the lure, the string is guided into the deepest point 65 of the slot 61. The player then applies an upward force on the lure, by reeling or tugging the string. The force causes the lure to move upward and into contact with the frontwardly-pivoting door 31 in much the same manner as when the forked head 17 was lifted as described above. The impact of the lure and the continued upward force pulls the door in an upward direction. The lure stays beneath the door 31, as long as the crest 75 of the aperture 71 is spaced a distance from the panel 10 that is greater than the distance between the deepest point 65 of the slot 61 and the panel 10. The momentum of the upwardly-moving lure is imparted to the frontwardly-pivoting door 31, which pivots upwardly toward the panel 10. As the frontwardly-pivoting door 31 becomes angled upwardly as it approaches the closed position, the upward force on the lure now displaces the string out of the slot 61 away from the panel 10. As a result, the lure slips out from its position beneath the door 31, and the player continues to reel or tug the string to bring the lure upwardly through the aperture 71. However, the frontwardly-pivoting door 31 does not fall back to the open position once the lure slips from beneath the door 31. Instead, inertia causes the frontwardly-pivoting door 31 to continue moving upwardly into the closed position. Thereafter, the frontwardly-pivoting door 31 is held in the closed position by the magnet 35.

The game is played by a player casting his lure toward the doors with the goal of striking a door to open it and obtain points, either for striking doors in a particular order or within a predetermined time. Once one or more doors are opened, the player then attempts to reset the doors using the mechanisms described above. Using the invention, a casting game is enjoyed without wasting time walking to and from the game to reset the targets.

There are many additional and alternative structures for those described above, and these are too numerous to name. However, it is to be understood that the person of ordinary skill will understand that such alternatives are possible. For example, the panel 10 may include automatic reset devices, such as electric, battery, air or other force-generating mechanisms connected to the doors to close them. Furthermore, force-detecting devices, such as electronic sensors, could alternatively be connected to the doors to indicate a successful or unsuccessful hit by the lure. Such sensors could provide inputs to a computer or video game. The panel 10 may also include mechanisms for attaching accessories such as additional targets and artificial foliage that could vary the difficulty of the game. Additionally, the apertures in the lip could be substituted by angled tubes aligned with an opening at the top into which the lure is to be cast. Upon being cast into the opening, the lure falls down the tube and drops out the other end. The panel 10 may also include a handle for making the game more easily carried. The preferred panel includes an aesthetic theme image on the front face 11, such as an underwater scene with a fish painted across the doors.

While certain preferred embodiments of the present invention have been disclosed in detail, it is to be understood that various modifications may be adopted without departing from the spirit of the invention or scope of the following claims.

What is claimed is:

1. A casting game apparatus at which an object can be cast, the apparatus comprising:

(a) a stationary panel with a front face that faces toward a player and an opposite back face;

(b) at least one frontwardly-pivoting door substantially parallel to the panel when the door is in a closed position, wherein said door is pivotally mounted to the panel for pivoting frontwardly to an open position toward the player upon being struck by the cast object on the opposite, back face of the door;

(c) a lip connected to the panel above the door and an aperture formed through the lip;

(d) a slot formed in an upper edge of the door; and wherein said aperture has a crest spaced a distance from the front face of the panel that is less than a distance between the front face of the panel and a deepest point of the slot on the door in the open position.

2. The apparatus of claim 1, wherein the door has a bias that biases the door closed when the door is in the closed position.

3. The apparatus of claim 2, wherein the bias includes a magnet.

4. The apparatus of claim 1, further comprising at least one rearwardly-pivoting door that is substantially parallel to the panel when the rearwardly-pivoting door is in a closed position, wherein the rearwardly-pivoting door is pivotally mounted to the panel for pivoting rearwardly to an open position upon being struck by the object on a front face of the rearwardly-pivoting door.

5. The apparatus of claim 1, further comprising an accessory attachment.

6. The apparatus of claim 5, wherein the attachment is artificial foliage.

7. The apparatus of claim 5, wherein the attachment is a target.

8. The apparatus of claim 4, wherein the frontwardly-pivoting door is held in the closed position by a bias.

9. A casting game apparatus at which an object can be cast, the apparatus comprising:

(a) a stationary panel with a front face and a back face and at least one rearwardly-pivoting door substantially parallel to the panel when the door is in a closed position, wherein the door is pivotally mounted to the panel for pivoting rearwardly to an open position upon being struck by the object on a front face of the door;

(b) a reset rod beneath the door when the door is in the open position, said reset rod being movably mounted to pivot the door to the closed position upon displacement of the reset rod beyond a predetermined limit; and (c) at least one frontwardly-pivoting door substantially parallel to the panel when the frontwardly-pivoting door is in the closed position, wherein said frontwardly-pivoting door is pivotally mounted to the panel for pivoting frontwardly to the open position upon being struck by the object on a back face of the frontwardly-pivoting door.

10. The apparatus of claim 9, further comprising means for closing at least one of said doors.

11. The apparatus of claim 9, wherein at least one of said doors has a bias biasing at least one of said doors closed when at least one of said doors is in the closed position.

12. The apparatus of claim 11, wherein the bias is a counterweight.

13. The apparatus of claim 9, further comprising an accessory attachment.

14. The apparatus of claim 13, wherein the attachment is artificial foliage.

15. The apparatus of claim 13, wherein the attachment is a target.

16. The apparatus of claim 9, wherein the rearwardly-pivoting door is biased to the closed position by a counterweight.

17. A casting game apparatus at which an object can be cast, the apparatus comprising:

(a) a stationary panel with a front face and a back face;

(b) a plurality of rearwardly-pivoting doors substantially parallel to the panel when in a closed position and pivotally mounted to the panel for pivoting rearwardly to an open position upon being struck by the object on a front face of the door;

(c) a reset rod beneath the row of rearwardly-pivoting doors when the rearwardly-pivoting doors are in the open position, said reset rod being movably mounted to pivot the rearwardly-pivoting doors to the closed position upon displacement of the reset rod beyond a predetermined limit;

(d) a plurality of frontwardly-pivoting doors, each door having a slot formed in an upper edge thereof, each door being substantially parallel to the panel when the frontwardly-pivoting doors are in a closed position, wherein each of one the frontwardly-pivoting doors is pivotally mounted to the panel for pivoting frontwardly to an open position upon being struck by the object on a rear face of the door;

(e) a lip connected to the panel above the frontwardly-pivoting doors, said lip having at least one aperture formed through the lip above each of the frontwardly-pivoting doors, and each aperture having a crest spaced from the panel; and wherein each crest is spaced a distance from the front face of the panel a distance that is less than a distance between the front face of the panel and a deepest point of a corresponding slot on one of the frontwardly-pivoting doors when the door is in the open position.

18. The apparatus of claim 17, wherein said panel further includes a carrying handle.

19. The apparatus of claim 17, wherein said panel further includes an electronic sensor.

20. The apparatus of claim 17, wherein said row of frontwardly-pivoting doors is aligned above said row of rearwardly-pivoting doors.

21. The apparatus of claim 17, wherein each one of the frontwardly-pivoting doors is in an alternating pattern relative to each one of the rearwardly-pivoting doors.

22. A casting game apparatus at which an object on a string can be cast, the apparatus comprising:

(a) a stationary panel with a front face and a back face and at least one rearwardly-pivoting door substantially parallel to the panel when the door is in a closed position, wherein the door is pivotally mounted to the panel for pivoting rearwardly to an open position upon being struck by the object on a front face of the door; and (b) a reset rod beneath the door when the door is in the open position, said reset rod having a forked head mounted thereto and being movably mounted to pivot the door to the closed position upon displacement of the reset rod upwardly beyond a predetermined limit after extending the string through the forked head.

* * * * *